US009753389B2

(12) United States Patent
Momotani et al.

(10) Patent No.: US 9,753,389 B2
(45) Date of Patent: Sep. 5, 2017

(54) LIQUID DEVELOPER

(71) Applicant: KONICA MINOLTA, INC., Chiyoda-ku, Tokyo (JP)

(72) Inventors: Keiko Momotani, Ibaraki (JP); Masahiro Anno, Sakai (JP); Naoki Yoshie, Ibaraki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/855,670

(22) Filed: Sep. 16, 2015

(65) Prior Publication Data

US 2016/0085170 A1 Mar. 24, 2016

(30) Foreign Application Priority Data

Sep. 19, 2014 (JP) ..... 2014-191332

(51) Int. Cl.
*G03G 9/13* (2006.01)

(52) U.S. Cl.
CPC ..... *G03G 9/132* (2013.01)

(58) Field of Classification Search
CPC ..... G03G 9/132; G03G 9/13
USPC ..... 430/114, 112
See application file for complete search history.

(56) References Cited

U.S. PATENT DOCUMENTS

2012/0315577 A1 12/2012 Moriguchi et al.
2016/0085171 A1* 3/2016 Yoshie ..... G03G 9/132
430/114

FOREIGN PATENT DOCUMENTS

JP 2009-175670 A 8/2009
JP 2013-003197 A 1/2013
JP 2014-066883 A 4/2014

OTHER PUBLICATIONS

ESPACENET machine-assisted English-language translation of Japanese Patent 2014-066883 A (pub. Apr. 2014).*
Notice of Grounds of Rejection issued on Oct. 11, 2016, by the Japanese Patent Office in corresponding Japanese Patent Application No. 2014-191332, and an English translation of the Notice. (6 pages).

* cited by examiner

*Primary Examiner* — Janis L Dote
(74) *Attorney, Agent, or Firm* — Buchanan Ingersoll & Rooney PC

(57) ABSTRACT

A liquid developer contains an insulating liquid and toner particles dispersed in the insulating liquid. The toner particles have a resin and a coloring agent. The resin contains at least 10 mass % and at most 40 mass % of an aliphatic polyester resin and at least 60 mass % and at most 90 mass % of an aromatic polyester resin. The resin has an acid value not less than 20 mgKOH/g and not more than 100 mgKOH/g. A difference in acid value between the aliphatic polyester resin and the aromatic polyester resin is not less than 0 mgKOH/g and not more than 10 mgKOH/g.

5 Claims, 1 Drawing Sheet

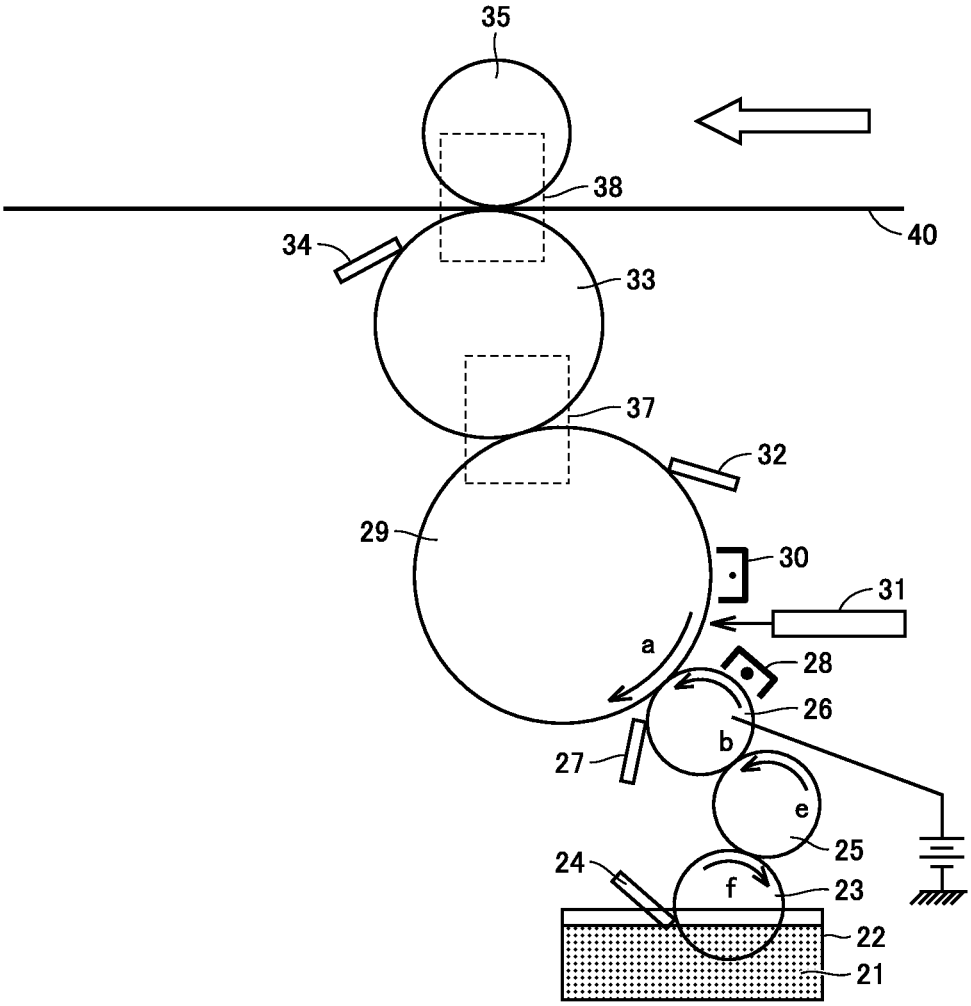
35
38
40
34
33
37
32
29
30
31
a
28
26
b
27
e
25
24
f
23
22
21

LIQUID DEVELOPER

This application is based on Japanese Patent Application No. 2014-191332 filed with the Japan Patent Office on Sep. 19, 2014, the entire content of which is hereby incorporated by reference.

BACKGROUND OF THE INVENTION

Field of the Invention

The present invention relates to a liquid developer.

Description of the Related Art

Japanese Laid-Open Patent Publication No. 2013-003197 describes toner particles containing a polyester resin. According to this document, document offset can be prevented when a solid obtained by drying a liquid developer has a melting point not lower than 55° C., and the solid of the liquid developer has a melting point not lower than 55° C. by setting a total amount of a constitutional unit derived from an aliphatic monomer occupied in both constitutional units of a constitutional unit derived from an acid component and a constitutional unit derived from an alcohol component to 30 mol % or higher.

Japanese Laid-Open Patent Publication No. 2009-175670 describes toner particles having a polyester resin containing as an acid component, phthalic acid and aromatic acid having three or more functional groups. According to this document, a liquid developer contains the toner particles and a basic high-polymer dispersant so that storage stability of the liquid developer can be maintained without fixability of the toner particles being interfered.

SUMMARY OF THE INVENTION

Though Japanese Laid-Open Patent Publication No. 2013-003197 and Japanese Laid-Open Patent Publication No. 2009-175670 describe fixation of toner particles to a recording medium at 180° C., the liquid developer is required to be fixed at a lower temperature (low-temperature fixability). Unlike a dry developer, the liquid developer can be controlled to have a particle size of toner particles not greater than 2 μm. Therefore, an amount of adhesion of the liquid developer to the recording medium can significantly be smaller than an amount of adhesion of a dry developer to the recording medium, which is advantageous in terms of low-temperature fixability. In addition, as a method for realizing fixation at a low temperature, it has been proposed to enhance meltability of a resin contained in toner particles or to employ a resin high in sharp-melting property (for example, a polyester resin).

When an amorphous polyester resin is employed as a resin to be contained in toner particles, a softening point thereof can be lowered by adjusting a molecular weight of the amorphous polyester resin. Therefore, fixation at a low temperature (for example, fixation at 90° C.) can be achieved. With lowering in softening point of the amorphous polyester resin, however, a glass transition point thereof also lowers, which leads to lowering in heat resistance of the toner particles. For example, it becomes difficult for toner particles to be resistant to heat at 50° C. or higher.

On the other hand, a crystalline polyester resin has a melting point lower than the softening point of the amorphous polyester resin. Therefore, use of the crystalline polyester resin as a resin to be contained in toner particles can allow fixation at a low temperature without lowering in heat resistance of the toner particles. Therefore, use of the crystalline polyester resin as the resin to be contained in toner particles is preferred.

The crystalline polyester resin is mainly composed of an aliphatic monomer, while the amorphous polyester resin is mainly composed of an aromatic monomer. Here, since a resin composed of an aliphatic monomer is softer than a resin composed of an aromatic monomer, it tends to be weak against stress. Therefore, when the crystalline polyester resin is employed as the resin to be contained in toner particles, in a scratch test conducted on an image fixed to a recording medium, the image is scratched. Namely, resistance to scratch of an image lowers.

A recording medium includes coated paper and quality paper. Since a coating layer is formed on a surface of the coated paper (a surface of the coated paper on which an image is to be formed), chemical adhesiveness and physical adhesiveness between toner particles and the surface of the coated paper can be ensured. A coating layer, however, is not formed on a surface of the quality paper (a surface of the quality paper on which an image is to be formed), and hence there are projections and recesses due to fibers forming the quality paper. Therefore, it is difficult to have toner particles adhere to the surface of the quality paper. In addition, since the toner particles contained in a liquid developer are small in particle size, it becomes difficult to apply pressure (fixation pressure) to the projections and recesses formed in the surface of the quality paper with these toner particles being interposed. As set forth above, when a liquid developer is employed, it becomes noticeably difficult to ensure adhesion strength of toner particles to quality paper.

The present invention was made in view of such aspects, and an object of the present invention is to achieve both of improvement in fixability of toner particles at a low temperature and improvement in resistance to scratch of an image, and further to enhance adhesion strength of toner particles to quality paper.

A resin composed of an aromatic monomer is harder than a resin composed of an aliphatic monomer. Therefore, it is expected that use of an aromatic polyester resin as a resin to be contained in toner particles can enhance resistance to scratch of an image. When fixation at a low temperature is attempted only with an aromatic polyester resin as the resin to be contained in toner particles, however, heat resistance of toner particles is lowered.

On the other hand, when only an aliphatic polyester resin is employed as the resin to be contained in toner particles, only a crystalline polyester resin will be employed as the resin to be contained in toner particles. Therefore, the toner particles can be fixed at a low temperature without lowering in heat resistance of the toner particles. Resistance to scratch of an image, however, is lowered.

From the foregoing, the present inventors have assumed that, by using both of an aliphatic polyester resin and an aromatic polyester resin as resins to be contained in toner particles, the toner particles can be fixed at a low temperature without lowering in heat resistance of the toner particles and in addition resistance to scratch of an image can be improved. Then, the present inventors have formed toner particles with both of an aliphatic polyester resin and an aromatic polyester resin, and examined characteristics of the toner particles. Then, it has been found that adhesion strength of toner particles to quality paper may lower when quality paper is employed as a recording medium in some cases.

In order to find out the cause of such a result, the present inventors have analyzed toner particles of which adhesion strength to quality paper was low and toner particles of which adhesion strength to quality paper was high. Consequently, in the toner particles of which adhesion strength to quality paper was low, a polyester resin contained in toner particles had a low acid value and the aliphatic polyester resin and the aromatic polyester resin were not compatible with each other. On the other hand, in the toner particles of which adhesion strength to quality paper was high, a polyester resin contained in toner particles had a high acid value or the aliphatic polyester resin and the aromatic polyester resin were compatible with each other. Furthermore, the present inventors have assumed that, when the aliphatic polyester resin and the aromatic polyester resin are not compatible with each other, an insulating liquid in the liquid developer is readily held at an interface between the aliphatic polyester resin and the aromatic polyester resin, and hence adhesiveness to quality paper may lower. Based on such assumption, the liquid developer according to the present invention was completed.

A liquid developer according to the present invention contains an insulating liquid and toner particles dispersed in the insulating liquid. The toner particles contain a resin and a coloring agent. The resin contains at least 10 mass % and at most 40 mass % of an aliphatic polyester resin and at least 60 mass % and at most 90 mass % of an aromatic polyester resin. The resin has an acid value not less than 20 mgKOH/g and not more than 100 mgKOH/g. A difference in acid value between the aliphatic polyester resin and the aromatic polyester resin is not less than 0 mgKOH/g and not more than 10 mgKOH/g.

A polyester resin is synthesized through condensation polymerization reaction between carboxylic acid (a constitutional unit derived from an acid component) and alcohol (a constitutional unit derived from an alcohol component). Therefore, a portion derived from carboxylic acid becomes a constitutional unit derived from the acid component, a portion derived from alcohol becomes a constitutional unit derived from the alcohol component, and a polyester resin is constructed as these constitutional units are repeated.

An "aliphatic polyester resin" means that, in an aliphatic polyester resin, a content of a constitutional unit derived from an aliphatic monomer in both constitutional units of a constitutional unit derived from an alcohol component and a constitutional unit derived from an acid component is not lower than 90 mass %. A "constitutional unit derived from an alcohol component" means a constitutional unit with a hydrogen atom having been removed from a hydroxyl group (an OH group) contained in alcohol, and includes a constitutional unit with a hydrogen atom having been removed from at least one hydroxyl group contained in alcohol. A "constitutional unit derived from an acid component" means a constitutional unit with a hydroxyl group having been removed from a carboxyl group (a COOH group) of carboxylic acid and includes a constitutional unit with a hydroxyl group having been removed from at least one carboxyl group contained in carboxylic acid. The "aliphatic monomer" includes aliphatic carboxylic acid, ester of lower alkyl of aliphatic carboxylic acid, acid anhydride of aliphatic carboxylic acid, and aliphatic alcohol. "Aliphatic carboxylic acid" means carboxylic acid not having an aromatic ring. "Aliphatic alcohol" means alcohol not having an aromatic ring.

An "aromatic polyester resin" means that, in an aromatic polyester resin, a content of a constitutional unit derived from an aromatic monomer in both constitutional units of a constitutional unit derived from an alcohol component and a constitutional unit derived from an acid component is not lower than 90 mass %. The "aromatic monomer" includes aromatic carboxylic acid, ester of lower alkyl of aromatic carboxylic acid, acid anhydride of aromatic carboxylic acid, and aromatic alcohol. "Aromatic carboxylic acid" means carboxylic acid having an aromatic ring. "Aromatic alcohol" means alcohol having an aromatic ring.

An "acid value of a resin" means an acid value of a resin (a resin component contained in a liquid developer) measured in compliance with a method described under JIS K 0070: 1992 (test methods for acid value, saponification value, ester value, iodine value, hydroxyl value and unsaponifiable matter of chemical products), and is based on an amount of carboxyl groups contained in such a resin component. A resin component contained in a liquid developer includes an aliphatic polyester resin and an aromatic polyester resin.

An "acid value of an aliphatic polyester resin" means an acid value of an aliphatic polyester resin measured in compliance with the method described under JIS K 0070: 1992, and is based on an amount of carboxyl groups contained in an aliphatic polyester resin. A "carboxyl group contained in an aliphatic polyester resin" is based on an amount of residues of carboxyl groups which have not reacted with hydroxyl groups (OH groups) during condensation polymerization reaction for synthesis of an aliphatic polyester resin.

An "acid value of an aromatic polyester resin" means an acid value of an aromatic polyester resin measured in compliance with the method described under JIS K 0070: 1992, and is based on an amount of carboxyl groups contained in an aromatic polyester resin. A "carboxyl group contained in an aromatic polyester resin" is based on an amount of residues of carboxyl groups which have not reacted with hydroxyl groups during condensation polymerization reaction for synthesis of an aromatic polyester resin.

Preferably, a resin has an acid value not less than 30 mgKOH/g and not more than 100 mgKOH/g. Preferably, the resin contains at least 10 mass % and at most 30 mass % of the aliphatic polyester resin and at least 70 mass % and at most 90 mass % of the aromatic polyester resin.

Preferably, at least one of the aliphatic polyester resin and the aromatic polyester resin contains three or more functional groups as a constitutional unit derived from an acid component. More preferably, a first constitutional unit of the aliphatic polyester resin is identical to the first constitutional unit of the aromatic polyester resin. Here, examples of the "functional group" include a carboxyl group.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic conceptual diagram of a part of an image formation apparatus of an electrophotography type.

DESCRIPTION OF THE PREFERRED EMBODIMENTS

[Liquid Developer]

A liquid developer according to the present embodiment is useful as a liquid developer for electrophotography used in an image formation apparatus of an electrophotography type (which will be described later) such as a copying machine, a printer, a digital printer, or a simple printer, a paint, a liquid developer for electrostatic recording, an oil-based ink for ink jet printer, or an ink for electronic paper. The liquid developer according to the present embodiment contains an insulating liquid and toner particles dispersed in the insulating liquid, and preferably contains 10 to 50 mass % of toner particles and 50 to 90 mass % of the insulating liquid. The liquid developer according to the present embodiment may contain an optional component different from the insulating liquid and the toner particles. Such an optional component includes, for example, a toner dispersant, a charge control agent, or a thickener.

<Toner Particles>

Toner particles in the present embodiment have a resin and a coloring agent dispersed in the resin, and preferably have 50 to 90 mass % of the resin and 10 to 50 mass % of the coloring agent. The toner particles according to the present embodiment may contain an optional component different from the resin and the coloring agent. Such an optional component includes, for example, a dispersant for a pigment, a wax, or a charge control agent.

A median diameter D50 found through measurement of particle size distribution of toner particles based on volume (hereinafter denoted as "median diameter D50 of toner particles") is preferably not smaller than 0.5 μm and not greater than 5.0 μm. This median diameter is smaller than a particle size of toner particles contained in a conventional dry developer, and represents one of the features of the present embodiment. If a median diameter D50 of toner particles is not smaller than 0.5 μm, a particle size of the toner particles can be ensured and hence mobility of toner particles in electric field is improved and development performance can be enhanced. If a median diameter D50 of toner particles is not greater than 5 μm, dispersibility of the toner particles can be ensured and hence image quality can be enhanced. More preferably, toner particles have a median diameter D50 not smaller than 1.0 μm and not greater than 3.0 μm.

Median diameter D50 of toner particles can be measured, for example, with a flow particle image analyzer ("FPIA-3000S" (model number) manufactured by Sysmex Corporation). This analyzer can use a solvent as it is as a dispersion medium. Therefore, this analyzer can measure a state of toner particles in a state closer to an actually dispersed state, as compared with a system in which measurement is conducted in a water system.

<Resin>

(Content of Aliphatic Polyester Resin and Content of Aromatic Polyester Resin)

A resin contained in toner particles includes at least 10 mass % and at most 40 mass % of an aliphatic polyester resin and at least 60 mass % and at most 90 mass % of an aromatic polyester resin. When a content of the aliphatic polyester resin (a ratio of a mass of the aliphatic polyester resin to a mass of resins contained in the toner particles) is not lower than 10 mass %, a content of a resin low in melting point (an aliphatic polyester resin) can be ensured and hence fixation at a low temperature can be achieved. When a content of the aliphatic polyester resin is not higher than 40 mass %, a content of a hard resin (an aromatic polyester resin) can be ensured and hence resistance to scratch of an image can be enhanced. Preferably, a content of the aliphatic polyester resin is not lower than 10 mass % and not higher than 30 mass %. Since a content of a hard resin can thus further be ensured, resistance to scratch of an image can further be enhanced.

When a content of the aromatic polyester resin (a ratio of a mass of the aromatic polyester resin to a mass of resins contained in the toner particles) is not lower than 60 mass %, a content of a hard resin (the aromatic polyester resin) can be ensured and hence resistance to scratch of an image can be enhanced. When a content of the aromatic polyester resin is not higher than 90 mass %, a content of the resin low in melting point (the aliphatic polyester resin) can be ensured and hence fixation at a low temperature can be achieved.

A content of the aliphatic polyester resin and a content of the aromatic polyester resin can be determined by conducting $^{1}$H-NMR analysis with a Fourier transform nuclear magnetic resonance spectrometer (FT-NMR) (trade name: "LAMBDA 400" manufactured by JEOL Ltd.) and finding an integration ratio. A chloroform-d (deuterochloroform) solvent can be employed as a measurement solvent. A content of a constitutional unit derived from an aliphatic monomer in both constitutional units of a constitutional unit derived from an alcohol component and a constitutional unit derived from an acid component and a content of a constitutional unit derived from an aromatic monomer in both constitutional units of a constitutional unit derived from an alcohol component and a constitutional unit derived from an acid component can also be measured with a similar method.

(Acid Value of Resin)

In the present embodiment, a resin has an acid value not less than 20 mgKOH/g and not more than 100 mgKOH/g. When the resin has an acid value not less than 20 mgKOH/g, adhesion strength of toner particles to a recording medium can be enhanced, and hence adhesion strength of toner particles to quality paper can be enhanced. As the resin has a higher acid value, toner particles will have polarity and hence adhesion strength of toner particles to quality paper can be enhanced. Therefore, preferably, the resin has an acid value not less than 30 mgKOH/g. It is difficult to actually increase an acid value of the resin to more than 100 mgKOH/g.

Preferably, at least one of the aliphatic polyester resin and the aromatic polyester resin has a first constitutional unit containing three or more functional groups, as a constitutional unit derived from an acid component. Since the resin thus has a higher acid value, adhesion strength of toner particles to quality paper can further be enhanced.

Examples of an aliphatic monomer which is the first constitutional unit include butanetricarboxylic acid, cyclohexanetricarboxylic acid, hexanetetracarboxylic acid, octanetetracarboxylic acid, biphenyltetracarboxylic acid, or butanetetracarboxylic acid. Acid anhydride thereof or ester of lower alkyl thereof can also be employed as the aliphatic monomer which is the first constitutional unit. In the aliphatic polyester resin, the aliphatic monomer which is the constitutional unit derived from the acid component contains preferably at least 1 mass % and at most 10 mass % of the aliphatic monomer which is the first constitutional unit. When the aliphatic monomer which is the constitutional unit derived from the acid component contains at least 1 mass % of the aliphatic monomer which is the first constitutional unit, the resin has a higher acid value and hence adhesion strength of toner particles to quality paper can further be enhanced. When the aliphatic monomer which is the constitutional unit derived from the acid component contains at most 10 mass % of the aliphatic monomer which is the first constitutional unit, fixability at a low temperature is excellent.

Examples of an aromatic monomer which is the first constitutional unit include trimellitic acid, trimesic acid, naphthalenetricarboxylic acid, benzophenone tetracarboxylic acid, or pyromellitic acid. Acid anhydride thereof or ester of lower alkyl thereof can also be employed as the aromatic monomer which is the first constitutional unit. In the aromatic polyester resin, the aromatic monomer which is the constitutional unit derived from the acid component contains preferably at least 1 mass % and at most 20 mass % of the aromatic monomer which is the first constitutional unit. When the aromatic monomer which is the constitutional unit derived from the acid component contains at least 1 mass % of the aromatic monomer which is the first constitutional unit, the resin has a higher acid value and hence adhesion strength of toner particles to quality paper can further be enhanced. When the aromatic monomer which is the constitutional unit derived from the acid component contains at most 20 mass % of the aromatic monomer which is the first constitutional unit, fixability at a low temperature is excellent.

In the aliphatic polyester resin, a monomer which is a constitutional unit derived from an acid component may contain at most 10 mass % of an aromatic monomer which is a first constitutional unit. Thus, a resin can have a higher acid value without lowering in crystallinity of the aliphatic polyester resin.

In the aromatic polyester resin, a monomer which is a constitutional unit derived from an acid component may contain at most 10 mass % of an aliphatic monomer which is a first constitutional unit. Thus, a resin can have a higher acid value without lowering in hardness of the aromatic polyester resin.

More preferably, the first constitutional unit of the aliphatic polyester resin is identical to the first constitutional unit of the aromatic polyester resin. Since the aliphatic polyester resin and the aromatic polyester resin are thus readily entangled with each other three-dimensionally, the aliphatic polyester resin and the aromatic polyester resin are more likely to be compatible with each other. Therefore, adhesion strength of toner particles to quality paper can further be enhanced (which will be described later).

(Difference in Acid Value)

A difference in acid value between an aliphatic polyester resin and an aromatic polyester resin (which may hereinafter also be denoted as a "difference in acid value") is not less than 0 mgKOH/g and not more than 10 mgKOH/g. When the difference in acid value is not more than 10 mgKOH/g, a difference between an amount of carboxyl groups contained in the aliphatic polyester resin and an amount of carboxyl groups contained in the aromatic polyester resin can be suppressed and hence a difference in solubility parameter (SP) value between the aliphatic polyester resin and the aromatic polyester resin can be suppressed. Thus, affinity between the aliphatic polyester resin and the aromatic polyester resin is higher. Namely, the aliphatic polyester resin and the aromatic polyester resin are more likely to be compatible with each other. Therefore, adhesion strength of toner particles to quality paper can be enhanced.

Various methods are available as a method of suppressing a difference in SP value between the aliphatic polyester resin and the aromatic polyester resin. Reduction in difference in acid value, however, can bring about effective suppression of difference in SP value between the aliphatic polyester resin and the aromatic polyester resin.

So long as a difference in acid value is not less than 0 mgKOH/g and not more than 10 mgKOH/g, the aliphatic polyester resin may be higher in acid value than the aromatic polyester resin or the aromatic polyester resin may be higher in acid value than the aliphatic polyester resin.

An acid value of a polyester resin can be varied by varying an amount of residues of carboxyl groups in a polyester resin. Therefore, a method of adjusting an acid value of an aliphatic polyester resin includes, for example, changing a type of a constitutional unit derived from an alcohol component or a type of a constitutional unit derived from an acid component, changing a molar ratio in mixing between a monomer which is a constitutional unit derived from an alcohol component and a monomer which is a constitutional unit derived from an acid component, or changing a condition for condensation reaction. An acid value of an aromatic polyester resin can be adjusted with a similar method. By adopting any method of these, a difference in acid value can be adjusted to a value not less than 0 mgKOH/g and not more than 10 mgKOH/g.

(Constitutional Unit)

Examples of an aliphatic monomer which is a constitutional unit derived from an acid component include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, or 1,18-octadecanedicarboxylic acid. Ester of lower alkyl thereof or acid anhydride thereof may be employed. From a point of view of promotion of crystallinity of a polyester resin, adipic acid, sebacic acid, 1,10-decanedicarboxylic acid, or 1,12-dodecanedicarboxylic acid is more preferably employed. As such an aliphatic monomer, any of the above may be used alone or any two or more of the above may be used as combined.

Examples of an aliphatic monomer which is a constitutional unit derived from an alcohol component include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, or 1,20-eicosanediol. From a point of view of promotion of crystallinity of a polyester resin, ethylene glycol, 1,4-butanediol, 1,6-hexanediol, 1,9-nonanediol, or 1,10-decanediol is preferably employed. As such an aliphatic monomer, any of the above may be used alone or any two or more of the above may be used as combined.

Examples of an aromatic monomer which is a constitutional unit derived from an acid component include aromatic polycarboxylic acid, ester of lower alkyl of aromatic polycarboxylic acid, or acid anhydride of aromatic polycarboxylic acid. Specific examples include terephthalic acid, isophthalic acid, orthophthalic acid, 5-tert-butylisophthalic acid, 2,6-naphthalene dicarboxylic acid, 4,4'-biphenyldicarboxylic acid, or trimellitic acid. From a point of view of availability, terephthalic acid, isophthalic acid, or 5-tert-butylisophthalic acid is preferably employed.

An aromatic monomer which is a constitutional unit derived from an alcohol component can include aromatic polyalcohol. Specifically, an adduct of alkylene oxide to bisphenol A expressed in a chemical formula (I) below can be exemplified.

(I)

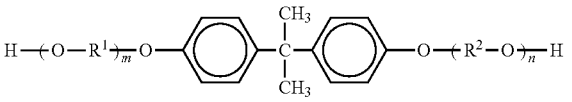

In the chemical formula (I), $R^1$ and $R^2$ each independently represent an alkylene group having a carbon number 2 or 3. m and n each independently represent 0 or a positive integer. The sum of m and n is not smaller than 1 and not greater than 16.

An aliphatic polyester resin has a number average molecular weight (Mn) preferably not smaller than 1000 and not greater than 25000, and the aliphatic polyester resin has a mass average molecular weight (Mw) preferably not smaller than 2000 and not greater than 200000. An aromatic polyester resin has a number average molecular weight (Mn) preferably not smaller than 1000 and not greater than 25000, and the aromatic polyester resin has a mass average molecular weight (Mw) preferably not smaller than 2000 and not greater than 200000. A number average molecular weight and a mass average molecular weight can be measured with gel permeation chromatography (GPC).

A resin contained in toner particles may contain less than 10 mass % of a resin other than the aliphatic polyester resin and the aromatic polyester resin. Examples of a resin other than the aliphatic polyester resin and the aromatic polyester resin include a styrene-acrylic resin, a urethane resin, or an epoxy resin. When the content of other resins is not lower than 10 mass %, it may become difficult to regularly arrange molecular chains of a polyester resin.

(Crystallinity and Non-Crystallinity)

"Crystallinity" of a "crystalline polyester resin" means that a ratio (Tm/Ta) between a softening point (hereinafter abbreviated as "Tm") of the polyester resin and a maximum peak temperature (hereinafter abbreviated as "Ta") of heat of fusion of the polyester resin is not lower than 0.8 and not higher than 1.55 and that a result of change in amount of heat obtained in differential scanning calorimetry (DSC) does not show stepwise change in amount of heat absorption but has a clear heat absorption peak.

"Non-crystallinity" of a "non-crystalline polyester resin" means that a ratio between Tm and Ta (Tm/Ta) is higher than 1.55. Tm and Ta can be measured with a method below.

A flow tester (capillary rheometer) (such as "CFT-500D" (model number) manufactured by Shimadzu Corporation) can be used to measure Tm. Specifically, while 1 g of a sample is heated at a temperature increase rate of 6° C./min., a plunger applies load of 1.96 MPa to the sample to thereby extrude the sample from a nozzle having a diameter of 1 mm and a length of 1 mm. Relation between "an amount of lowering of the plunger (a value of flow)" and a "temperature" is plotted in a graph. A temperature at the time when an amount of lowering of the plunger is ½ of a maximum value of the amount of lowering is read from the graph, and this value (a temperature at which half of the measurement sample was extruded from the nozzle) is adopted as Tm.

A differential scanning calorimeter (such as "DSC210" (model number) manufactured by Seiko Instruments, Inc.) can be used to measure Ta. Specifically, a sample is molten at 130° C., thereafter a temperature is lowered from 130° C. to 70° C. at a rate of 1.0° C./min., and thereafter a temperature is lowered from 70° C. to 10° C. at a rate of 0.5° C./min. Thereafter, with the DSC method, a temperature of the sample is raised at a temperature increase rate of 20° C./min., change in heat absorption and generation of the sample is measured, and relation between an "amount of heat absorption and generation" and a "temperature" is plotted in a graph. Here, a temperature of a heat absorption peak observed in a range from 20 to 100° C. is defined as Ta'. When there are a plurality of heat absorption peaks, a temperature of a peak largest in amount of heat absorption is defined as Ta'. After the sample was stored for 6 hours at (Ta'-10°) C., it is in turn stored for 6 hours at (Ta'-15°) C.

After pre-treatment of the sample ends, with the DSC method, the sample subjected to the pre-treatment above is cooled to 0° C. at a temperature lowering rate of 10° C./min., and then a temperature is raised at a temperature increase rate of 20° C./min. Based on change in heat absorption and generation thus measured, relation between an "amount of heat absorption and generation" and a "temperature" is plotted in a graph. A temperature at which an amount of heat absorption attains to a maximum value is defined as a maximum peak temperature (Ta) of heat of fusion.

<Coloring Agent>

A coloring agent is dispersed in at least one of an aliphatic polyester resin and an aromatic polyester resin, and has a particle size preferably not larger than 0.3 μm. When a coloring agent has a particle size not larger than 0.3 μm, dispersibility of the coloring agent can further be enhanced, and hence a degree of gloss of an image can further be enhanced. Therefore, a desired color is readily realized.

Though a conventionally known pigment can be employed as a coloring agent without being particularly limited, from a point of view of cost, light resistance, coloring capability, and the like, pigments below are preferably employed. In terms of color construction, these pigments are normally categorized into a black pigment, a yellow pigment, a magenta pigment, and a cyan pigment. Colors (color images) other than black are basically toned by subtractive color mixture of a yellow pigment, a magenta pigment, or a cyan pigment. A pigment shown below may be used alone, or two or more types of pigments shown below may be used together as necessary.

A pigment contained in a black coloring agent (a black pigment) may be, for example, carbon black such as furnace black, channel black, acetylene black, thermal black, or lamp black, carbon black derived from biomass, or magnetic powders of magnetite or ferrite. Nigrosine (an azine-based compound) which is a purple-black dye may be used alone or in combination. As nigrosine, C. I. SOLVENT BLACK 7 or C. I. SOLVENT BLACK 5 can be employed.

Examples of a pigment contained in a magenta coloring agent (a magenta pigment) include C. I. PIGMENT RED 2, C. I. PIGMENT RED 3, C. I. PIGMENT RED 5, C. I. PIGMENT RED 6, C. I. Pigment Red PIGMENT RED 7, C. I. PIGMENT RED 15, C. I. PIGMENT RED 16, C. I. PIGMENT RED 48:1, C. I. PIGMENT RED 53:1, C. I. PIGMENT RED 57:1, C. I. PIGMENT RED 122, C. I. PIGMENT RED 123, C. I. PIGMENT RED 139, C. I. PIGMENT RED 144, C. I. PIGMENT RED 149, C. I. PIGMENT RED 166, C. I. PIGMENT RED 177, C. I. PIGMENT RED 178, or C. I. PIGMENT RED 222.

Examples of a pigment contained in a yellow coloring agent (a yellow pigment) include C. I. PIGMENT ORANGE 31, C. I. PIGMENT ORANGE 43, C. I. PIGMENT YELLOW 12, C. I. PIGMENT YELLOW 13, C. I. PIGMENT YELLOW 14, C. I. PIGMENT YELLOW 15, C. I. PIGMENT YELLOW 17, C. I. PIGMENT YELLOW 74, C. I. PIGMENT YELLOW 93, C. I. PIGMENT YELLOW 94, C. I. PIGMENT YELLOW 138, C. I. PIGMENT YELLOW 155, C. I. PIGMENT YELLOW 180, or C. I. PIGMENT YELLOW 185.

Examples of a pigment contained in a cyan coloring agent (a cyan pigment) include C. I. PIGMENT BLUE 15, C. I. PIGMENT BLUE 15:2, C. I. PIGMENT BLUE 15:3, C. I. PIGMENT BLUE 15:4, C. I. PIGMENT BLUE 16, C. I. PIGMENT BLUE 60, C. I. PIGMENT BLUE 62, C. I. PIGMENT BLUE 66, or C. I. PIGMENT GREEN 7.

<Optional Component in Toner Particles (Dispersant for Pigment)>

A dispersant for pigment is exemplified as one example of an optional component in toner particles. A dispersant for pigment has a function to uniformly disperse a coloring agent (a pigment) in toner particles and it is preferably a basic dispersant. The basic dispersant refers to a dispersant defined below. Namely, 0.5 g of a dispersant for pigment and 20 ml of distilled water are introduced in a screw bottle made of glass, the screw bottle is shaken for 30 minutes with the use of a paint shaker, and the resultant product is filtered. pH of a filtrate thus obtained is measured with a pH meter (trade name: "D-51" manufactured by Horiba, Ltd.), and a filtrate of which pH is higher than 7 is defined as a basic dispersant. It is noted that a filtrate of which pH is lower than 7 is referred to as an acid dispersant.

A type of such a basic dispersant is not particularly limited. For example, a basic dispersant is preferably a compound having a functional group such as an amine group, an amino group, an amide group, a pyrrolidone group, an imine group, an imino group, a urethane group, a quaternary ammonium group, an ammonium group, a pyridino group, a pyridium group, an imidazolino group, or an imidazolium group in a molecule. It is noted that what is called a surfactant having a hydrophilic portion and a hydrophobic portion in a molecule normally falls under the dispersant. Various compounds, however, can be employed without limited to the surfactant, so long as they have a function to uniformly disperse a coloring agent (a pigment) in toner particles.

A commercially available product of such a basic dispersant may be, for example, "AJISPER PB-821" (trade name), "AJISPER PB-822" (trade name), or "AJISPER PB-881" (trade name) manufactured by Ajinomoto Fine-Techno Co., Inc., or "SOLSPERSE 28000" (trade name), "SOLSPERSE 32000" (trade name), "SOLSPERSE 32500" (trade name), "SOLSPERSE 35100" (trade name), or "SOLSPERSE 37500" (trade name) manufactured by Japan Lubrizol Limited.

A dispersant for pigment not dissolved in an insulating liquid is more preferably selected. In consideration of this point, "AJISPER PB-821" (trade name), "AJISPER PB-822" (trade name), or "AJISPER PB-881" (trade name) manufactured by Ajinomoto Fine-Techno Co., Inc. is more preferably employed. By using such a dispersant for pigment, it becomes easier to obtain toner particles having a desired shape, although a detailed mechanism is not known.

Preferably 1 to 100 mass % and more preferably 1 to 40 mass % of such a dispersant for pigment is added to the coloring agent (pigment). When an amount of addition of the dispersant for pigment is not lower than 1 mass %, dispersibility of the coloring agent (pigment) can be ensured, and hence necessary ID (image density) can be achieved and adhesion strength to a recording medium can be ensured. When an amount of addition of the dispersant for pigment is not higher than 100 mass %, the amount of addition of the dispersant for pigment can be prevented from being excessive. Therefore, the excessive dispersant for pigment can be prevented from being dissolved in the insulating liquid, and hence chargeability or adhesion strength of toner particles can be maintained in a satisfactory state. Such a dispersant for pigment may be used alone or two or more types of the dispersants for pigment may be used together as necessary.

<Insulating Liquid>

The insulating liquid has a resistance value preferably to such an extent as not distorting an electrostatic latent image (approximately from $10^{11}$ to $10^{16}$ Ω·cm) and preferably it is a solvent having low odor and toxicity. The insulating liquid is generally exemplified by aliphatic hydrocarbon, alicyclic hydrocarbon, aromatic hydrocarbon, halogenated hydrocarbon, or polysiloxane. In particular from a point of view of low odor and low harm as well as low cost, preferably a normal paraffin based solvent or an isoparaffin based solvent is employed as the insulating liquid. More preferably, MORESCO WHITE (trade name, manufactured by MORESCO Corporation), ISOPAR (trade name, manufactured by Exxon Mobil Corporation), or SHELLSOL (trade name, manufactured by Shell Chemicals Japan Ltd.) is employed, or IP SOLVENT 1620, IP SOLVENT 2028, or IP SOLVENT 2835 (each of which is trade name and manufactured by Idemitsu Kosan Co., Ltd.) is employed.

<Optional Component in Liquid Developer (Toner Dispersant)>

A toner dispersant is preferably a basic high-polymer dispersant, for a reason shown below. A resin contained in toner particles has a carboxyl group at the terminal. Therefore, when the basic high-polymer dispersant is employed as the toner dispersant, a good dispersed state of toner particles can be maintained for a long period of time owing to an interaction between the toner dispersant and the resin contained in the toner particles.

The toner dispersant is essential for uniformly dispersing toner particles as described above. The insulating liquid, however, is captured in the toner particles with the toner dispersant being interposed, and hence an amount of use of the toner dispersant is desirably small, because the insulating liquid remains in the toner particles owing to the toner dispersant during fixation and consequently fixation strength becomes weak.

For example, a nitrogen-containing resin having an amine group, an amide group, an imine group, a pyrrolidone group, or a urethane group in a molecule is preferred as such a basic high-polymer dispersant. In particular, a nitrogen-containing resin containing any of a urethane group, an amide group, and a pyrrolidone group in a molecule is suitable. This is because, with the use of a basic high-polymer dispersant, an amount of use of the toner dispersant can be small.

Examples of a nitrogen-containing resin having a urethane group in a molecule include a copolymer of a compound obtained through reaction between a compound having a hydroxyl group (an OH group) at the terminal and a compound having an isocyanate group and a vinyl compound having a long-chain alkyl group. Examples of a compound having a hydroxyl group (an OH group) at the terminal include hydroxyethyl methacrylate or hydroxyethyl acrylate. Examples of a compound having an isocyanate group include tolylenediisocyanate or isophoronediisocyanate.

Specific examples of a basic high-polymer dispersant include "DISPERBYK-109 (alkylolamino amide)" (trade name) or "DISPERBYK-130 (polyamine amides of unsaturated polycarboxylic acids)" (trade name) manufactured by BYK-Chemie GmbH and "SOLSPERSE 13940 (polyester amine based)" (trade name), "SOLSPERSE 17000" (trade name), "SOLSPERSE 18000" (trade name), "SOLSPERSE 19000 (fatty acid amine based)" (trade name), or "SOLSPERSE 11200" (trade name) manufactured by Japan Lubrizol Limited.

Further preferred examples of the basic high-polymer dispersant include a copolymer of a compound containing an atom group expressed in a chemical formula (II) below and a compound containing an atom group expressed in a chemical formula (III) below (that is, a copolymer of a vinyl compound having a long-chain alkyl group and polyvinylpyrrolidone). Examples of such a copolymer include "ANTARON V-216" (trade name), "ANTARON V-220" (trade name), or "ANTARON W-660" (trade name) manufactured by GAF Corporation/ISP Chemicals Inc.

(II)

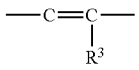

(III)

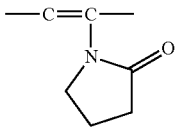

In the chemical formula (II) above, $R^3$ represents an alkyl group having a carbon number from 10 to 30. Though a copolymerization ratio (a molar ratio) between the atom group expressed by the chemical formula (II) and the atom group expressed by the chemical formula (III) is not particularly limited, a range from 20:80 to 90:10 is preferred and a range from 50:50 to 90:10 is more preferred. When a ratio of the atom group expressed by the chemical formula (III) is low, dispersibility of toner particles may become poor. When the carbon number of $R^3$ in the chemical formula (II) is smaller than 10, dispersibility of the toner particles may become poor. When the carbon number of $R^3$ in the chemical formula (II) exceeds 30, the basic high-polymer dispersant is less likely to be dissolved in an insulating liquid.

The toner dispersant in the present embodiment is not limited to the basic dispersant, and other dispersants such as an acid dispersant can be employed. As the toner dispersant in the present embodiment, one type of a material may be used alone or two or more types of materials may be used as combined.

<Manufacturing of Toner Particles>

Though a method of manufacturing toner particles in the present embodiment is not particularly limited, the toner particles in the present embodiment can be manufactured based on such a conventionally known technique as a granulation method or a crushing method.

The crushing method is a method in which a resin and a coloring agent such as a pigment are molten and mixed and then the mixture is crushed. Crushing is carried out in a dry state or a wet state such as in an insulating liquid.

The granulation method includes a suspension polymerization method, an emulsion polymerization method, a fine particle aggregation method, a method of adding a poor solvent to a resin solution for precipitation of toner particles, a spray drying method, and a manufacturing method of forming a resin contained in toner particles so as to have a core/shell structure by using two different types of resins, depending on a difference in mechanism for forming toner particles.

EXAMPLES

Though the present invention will be described hereinafter in further detail with reference to Examples, the present invention is not limited thereto.

Manufacturing Example 1: Synthesis of Adduct of Propylene Oxide (PO) to Bisphenol A In an autoclave provided with a stirring and temperature adjustment function, bisphenol A (228 g) and potassium hydroxide (2 g) were introduced and a temperature was raised to 135° C. Thereafter, propylene oxide (139 g) was introduced under a pressure condition from 0.1 to 0.4 MPa, and thereafter reaction was allowed for 3 hours. An adsorbent (trade name "KYOWAAD® 600" manufactured by Kyowa Chemical Industry Co., Ltd.) (16 g) was introduced in the thus obtained reaction product, which was stirred and aged for 30 minutes while the temperature was held at 90° C. Thereafter, filtration was carried out to thereby obtain an adduct of propylene oxide to bisphenol A. This adduct of propylene oxide was a mixture of a compound in which the sum (m+n) of m and n in the chemical formula (I) was 2 and a compound in which the sum (m+n) of m and n in the chemical formula (I) was 3.

Manufacturing Example 2: Synthesis of Aliphatic Polyester Resins A to E

In a four-neck flask to which a stirring rod, a partial condenser, a nitrogen gas introduction pipe, and a thermometer were attached, 1,6-hexanediol (an aliphatic monomer, a constitutional unit derived from an alcohol component), adipic acid (an aliphatic monomer, a constitutional unit derived from an acid component, having two functional groups), and trimellitic acid (an aromatic monomer, a constitutional unit derived from an acid component, having three functional groups) were introduced. An amount of blend was as shown in Table 1. A nitrogen gas was introduced while stirring was carried out, and tetrabutoxytitanate was added as a polymerization catalyst for condensation polymerization for 5 hours at a temperature of approximately 170° C. To an obtained aliphatic polyester resin A, 0.2 mass % of tetrabutoxytitanate (a polymerization catalyst) was added.

Then, the temperature was lowered to approximately 100° C., and condensation polymerization was stopped by adding 0.012 part by mass of hydroquinone (a polymerization inhibitor) to 100 parts by mass of the product. Aliphatic polyester resin A was thus obtained. An amount of blend was varied as shown in Table 1 and a condition for condensation polymerization was varied as appropriate, to thereby obtain aliphatic polyester resins B to E.

TABLE 1

| | Constitutional Unit of Alcohol Component | | Constitutional Unit of Acid Component (Number of Functional Groups: 2) | | Constitutional Unit of Acid Component (Number of Functional Groups: 3 or More) | | Content of | | |
|---|---|---|---|---|---|---|---|---|---|
| Type of Aliphatic Polyester Resin | Material | Amount of Blend (Parts by Mass) | Material | Amount of Blend (Parts by Mass) | Material | Amount of Blend (Parts by Mass) | Constitutional Unit Derived from Aliphatic Monomer*11 (Mass %) | Acid Value (mgKOH/g) | Mn |
| A | 1,6- | 120 | Adipic | 150 | Trimellitic Acid | 5 | 98 | 26 | 6700 |
| B | hexanediol | | Acid | 160 | (Number of Functional | 0 | 100 | 15 | 6000 |
| C | | | | 150 | Groups: 3) | 10 | 96 | 49 | 7000 |
| D | | | | 150 | | 0 | 100 | 8 | 6500 |

TABLE 1-continued

| Type of Aliphatic Polyester Resin | Constitutional Unit of Alcohol Component: Material | Constitutional Unit of Alcohol Component: Amount of Blend (Parts by Mass) | Constitutional Unit of Acid Component (Number of Functional Groups: 2): Material | Constitutional Unit of Acid Component (Number of Functional Groups: 2): Amount of Blend (Parts by Mass) | Constitutional Unit of Acid Component (Number of Functional Groups: 3 or More): Material | Constitutional Unit of Acid Component (Number of Functional Groups: 3 or More): Amount of Blend (Parts by Mass) | Content of Constitutional Unit Derived from Aliphatic Monomer*11 (Mass %) | Acid Value (mgKOH/g) | Mn |
|---|---|---|---|---|---|---|---|---|---|
| E | | | | 150 | Meso-Butane-1,2,3,4-Tetracarboxylic Acid (Number of Functional Groups: 4) | 10 | 100 | 65 | 6300 |

In Table 1, "content of constitutional unit derived from aliphatic monomer*11 (mass %)" means a content of a constitutional unit derived from an aliphatic monomer in both constitutional units of a constitutional unit derived from an alcohol component and a constitutional unit derived from an acid component in an aliphatic polyester resin.

An acid value of aliphatic polyester resins A to E was measured in compliance with the method described under JIS K 0070: 1992 (test methods for acid value, saponification value, ester value, iodine value, hydroxyl value and unsaponifiable matter of chemical products). Table 1 shows results.

polymerization for 5 hours at a temperature of approximately 170° C. To an obtained aromatic polyester resin a, 0.2 mass % of tetrabutoxytitanate (a polymerization catalyst) was added.

Then, the temperature was lowered to approximately 100° C., and condensation polymerization was stopped by adding 0.012 part by mass of hydroquinone (a polymerization inhibitor) to 100 parts by mass of the product. Aromatic polyester resin a was thus obtained. An amount of blend was varied as shown in Table 2 and a condition for condensation polymerization was varied as appropriate, to thereby obtain aromatic polyester resins b to d.

TABLE 2

| Type of Aromatic Polyester Resin | Constitutional Unit of Alcohol Component: Material | Constitutional Unit of Alcohol Component: Amount of Blend (Parts by Mass) | Constitutional Unit of Acid Component (Number of Functional Groups: 2): Material | Constitutional Unit of Acid Component (Number of Functional Groups: 2): Amount of Blend (Parts by Mass) | Constitutional Unit of Acid Component (Number of Functional Groups: 2): Material | Constitutional Unit of Acid Component (Number of Functional Groups: 2): Amount of Blend (Parts by Mass) | Content of Constitutional Unit Derived from Aromatic Monomer*21 (Mass %) | Acid Value (mgKOH/g) | Mn |
|---|---|---|---|---|---|---|---|---|---|
| a | Adduct of PO to | 370 | Terephthalic | 170 | Trimellitic | 8 | 100 | 35 | 7500 |
| b | Bisphenol A | 370 | Acid | 180 | Acid | 0 | 100 | 22 | 5000 |
| c | | 370 | | 170 | | 12 | 100 | 57 | 8000 |
| d | | 370 | | 170 | | 0 | 100 | 12 | 6600 |

Mn of aliphatic polyester resins A to E was measured with GPC. Table 1 shows results.

Manufacturing Example 3: Synthesis of Aromatic Polyester Resins a to d

In a four-neck flask to which a stirring rod, a partial condenser, a nitrogen gas introduction pipe, and a thermometer were attached, the adduct of PO to bisphenol A (an aromatic monomer, a constitutional unit derived from an alcohol component) obtained in Manufacturing Example 1, terephthalic acid (an aromatic monomer, a constitutional unit derived from an acid component, having two functional groups), and trimellitic acid (an aromatic monomer, a constitutional unit derived from an acid component, having three functional groups) were introduced. An amount of blend was as shown in Table 2. A nitrogen gas was introduced while stirring was carried out, and tetrabutoxytitanate was added as a polymerization catalyst for condensation In Table 2, "content of constitutional unit derived from aromatic monomer*21 (mass %)" means a content of a constitutional unit derived from an aromatic monomer in both constitutional units of a constitutional unit derived from an alcohol component and a constitutional unit derived from an acid component in an aromatic polyester resin.

An acid value and Mn of aromatic polyester resins a to d were measured in accordance with the method described in Manufacturing Example 2. Table 2 shows results.

Manufacturing Example 4: Manufacturing of Dispersion Liquid of Coloring Agent In a beaker, 20 parts by mass of copper phthalocyanine (a coloring agent, trade name "FASTGEN BLUE FDB-14" manufactured by DIC Corporation), 5 parts by mass of a dispersant for a coloring agent (trade name "AJISPERPB-821" manufactured by Ajinomoto Fine-Techno Co., Inc.), and 75 parts by mass of acetone were introduced. After copper phthalocyanine was uniformly dispersed, it was finely dispersed with the use of a bead mill. Thus, a dispersion liquid of a coloring agent was obtained. A volume average particle size of copper phthalocyanine in the dispersion liquid of the coloring agent was 0.2 μm.

Manufacturing Example 5: Manufacturing of Solutions Y1 to Y3 for Forming Resin A solution Y1 for forming a resin was obtained by dissolving 28 parts by mass of aliphatic polyester resin A and 72 parts by mass of aromatic polyester resin a in 150 parts by mass of acetone. Solutions Y2 to Y3 for forming a resin were obtained by changing a type or an amount of blend of the aliphatic polyester resin or a type or an amount of blend of the aromatic polyester resin as shown in Table 3.

TABLE 3

| Type of Solution for Forming Resin | Aliphatic Polyester Resin | | Aromatic Polyester Resin | | Acetone |
|---|---|---|---|---|---|
| | Type | Amount of Blend (Parts by Mass) | Type | Amount of Blend (Parts by Mass) | Amount of Blend (Parts by Mass) |
| Y1 | A | 28 | a | 72 | 150 |
| Y2 | A | 12 | a | 88 | 150 |
| Y3 | E | 20 | c | 80 | 150 |

Example 1

A HENSCHEL MIXER was used to sufficiently mix 28 parts by mass of aliphatic polyester resin A, 72 parts by mass of aromatic polyester resin a, and 20 parts by mass of copper phthalocyanine (a coloring agent, trade name "FASTGEN BLUE FDB-14" manufactured by DIC Corporation). Thereafter, the mixture was cooled after it was molten and mixed with the use of a twin screw extruder. The obtained solid was coarsely crushed and thereafter finely crushed with the use of a jet mill. Toner particles having an average particles size of 6 μm were thus obtained.

After 34 parts by mass of obtained toner particles, 0.25 part by mass of a toner dispersant (a basic high-polymer dispersant, trade name "ANTARON V-216" manufactured by GAF Corporation/ISP Chemicals Inc.), 100 parts by mass of an insulating liquid (trade name "IP SOLVENT 2028" manufactured by Idemitsu Kosan Co., Ltd.), and 100 parts by mass of zirconia beads were mixed, they were stirred for 50 hours with the use of a sand mill. A liquid developer in the present Example was thus obtained. The toner particles contained in the liquid developer had a median diameter D50 of 2.6 μm.

Examples 2 to 6 and Comparative Examples 1 to 5

A liquid developer was manufactured in accordance with the method described in Example 1 except for change in type or content of an aliphatic polyester resin or a type or a content of an aromatic polyester resin as shown in Table 4.

TABLE 4

| | Resin | | | | | | | | | | |
|---|---|---|---|---|---|---|---|---|---|---|---|
| | Aliphatic Polyester Resin | | | Aromatic Polyester Resin | | | Difference in Acid | Acid Value | Method of | | |
| | Type | Content (Mass %) | Acid Value (mgKOH/g) | Type | Content (Mass %) | Acid Value (mgKOH/g) | Value (mgKOH/g) | of Resin (mgKOH/g) | Manufacturing Toner Particles | Adhesion Strength | Resistance to Scratch |
| Example 1 | A | 28 | 26 | a | 72 | 35 | 9 | 32 | Crushing | A1 | A2 |
| Example 2 | A | 12 | 26 | a | 88 | 35 | 9 | 34 | Crushing | A1 | A2 |
| Example 3 | A | 40 | 26 | a | 60 | 35 | 9 | 31 | Crushing | A1 | B2 |
| Example 4 | B | 20 | 15 | b | 80 | 22 | 7 | 21 | Crushing | B1 | A2 |
| Example 5 | C | 20 | 49 | c | 80 | 57 | 8 | 55 | Crushing | A1 | A2 |
| Example 6 | E | 20 | 65 | c | 80 | 57 | 8 | 59 | Crushing | A1 | A2 |
| Example 7 | A | 28 | 26 | a | 72 | 35 | 9 | 32 | Granulation | A1 | A2 |
| Example 8 | A | 12 | 26 | a | 88 | 35 | 9 | 34 | Granulation | A1 | A2 |
| Example 9 | E | 20 | 65 | c | 80 | 57 | 8 | 59 | Granulation | A1 | A2 |
| Comparative Example 1 | — | 0 | 0 | a | 100 | 35 | — | 35 | Crushing | C1 | A2 |
| Comparative Example 2 | A | 50 | 26 | a | 50 | 35 | 9 | 31 | Crushing | B1 | C2 |
| Comparative Example 3 | D | 20 | 8 | d | 80 | 12 | 4 | 11 | Crushing | C1 | A2 |
| Comparative Example 4 | B | 20 | 15 | a | 80 | 35 | 20 | 31 | Crushing | C1 | A2 |
| Comparative Example 5 | E | 20 | 65 | a | 80 | 35 | 30 | 41 | Crushing | C1 | A2 |

Example 7

In a beaker, 40 parts by mass of solution Y1 for forming a resin and 20 parts by mass of the dispersion liquid of the coloring agent (Manufacturing Example 4) were introduced, which was stirred with TK AUTO HOMO MIXER (manufactured by Tokushu Kika Kogyo Co., Ltd.) at 25° C. at 8000 rpm, so that the coloring agent was uniformly dispersed. A resin solution was thus obtained.

Then, 15 parts by mass of a toner dispersant (a basic high-polymer dispersant, trade name "SOLSPERSE 11200" (manufactured by Japan Lubrizol Limited) was dissolved in 85 parts by mass of an insulating liquid (trade name "IP SOLVENT 2028" manufactured by Idemitsu Kosan Co., Ltd.). A dispersant solution was thus obtained.

In another beaker, 56 parts by mass of an insulating liquid (trade name "IP SOLVENT 2028" manufactured by Idemitsu Kosan Co., Ltd.) and 11 parts by mass of the dispersant solution were introduced and uniformly dispersed. Thereafter, while TK AUTO HOMO MIXER was used at 25° C. to perform stirring at 10000 rpm, 60 parts by mass of the resin solution was introduced and stirred for 2 minutes. The obtained liquid mixture was introduced in a reaction vessel provided with a stirrer, a heating and cooling apparatus, a thermometer, and a desolventizer, and a temperature was raised to 35° C. Thereafter, at a reduced pressure of 0.039 MPa at that temperature, acetone was distilled out until a concentration of acetone was not higher than 0.5 mass %. Thus, a liquid developer was obtained. The obtained liquid developer contained 25 mass % of a solid (toner particles).

Example 8

A liquid developer was obtained in accordance with the method described in Example 7 except for change of solution Y1 for forming a resin to solution Y2 for forming a resin.

Example 9

A liquid developer was obtained in accordance with the method described in Example 7 except for change of solution Y1 for forming a resin to solution Y3 for forming a resin.

<Measurement of Median Diameter D50 of Toner Particles>

It was confirmed in Examples 1 to 9 and Comparative Examples 1 to 5 that toner particles had a median diameter D50 not greater than 5 μm.

<Measurement of Adhesion Strength (Adhesion Strength of Toner Particles to Quality Paper>

Initially, a solid fill pattern image was formed on a recording medium (quality paper (trade name "KINBISHI" manufactured by Mitsubishi Paper Mills Limited), 127.9 g/m$^2$) in) accordance with a method which will be described later. Thereafter, a yet-to-be-fixed image was fixed to the recording medium with the use of a heat roller fixer. Here, a set temperature of the roller was 120° C., a fixation NIP time was set to 50 msec., and a temperature of the recording medium immediately after passage of the heat roller fixer was 90° C.

Then, a tape (trade name "SCOTCH mending tape" manufactured by Sumitomo 3M Limited) was stuck to a site to be measured in the recording medium to which the image was fixed. Thereafter, the tape was peeled off from the site to be measured and stuck to reference paper (trade name "CF PAPER" manufactured by Konica Minolta Business Solutions Japan Co., Ltd.). A reflection densitometer (trade name: "SPECTRO EYE" manufactured by X-Rite, Incorporated) was used to measure an image density (ID) of a portion where the tape was stuck. An image density for evaluation was thus measured.

A tape was stuck to the reference paper without sticking the tape to the recording medium, and an image density of a portion where the tape was stuck (reference image density) was measured. Then, a difference (ΔID) between the image density for evaluation and the reference image density was found. Table 4 shows results.

In Table 4, ΔID less than 0.1 is denoted as "A1", ΔID not less than 0.1 and less than 0.15 is denoted as "B1", and ΔID not less than 0.15 is denoted as "C1". Lower ΔID indicates that a fixed image is less likely to be peeled off by the tape, and hence it can be concluded that adhesion strength of toner particles to quality paper is high. In the present Example, the set temperature of the roller during fixation was 120° C. and the temperature of the recording medium immediately after passage of the heat roller fixer was 90° C. Therefore, it can be concluded that fixation at a low temperature could be realized if the image density was low.

<Evaluation of Resistance to Scratch>

Resistance to scratch was evaluated by using the image used at the time of measurement of adhesion strength. When adhesion strength was evaluated as B1 or C1, however, a fixation temperature was adjusted so that an image of which adhesion strength was evaluated as A1 was fabricated, and then resistance to scratch of that image was evaluated.

Specifically, an indenter made of copper having a radius of 2.5 mm was brought in contact with an image for evaluation. The image for evaluation was moved by 30 mm at a scanning speed of 5 mm/s while load onto the image for evaluation was applied to the indenter. With load applied to the indenter being varied, a minimum value for "weight" (minimum weight) at the time when a scratch formed in a surface of the image for evaluation could be recognized with naked eyes was examined. Here, the "weight" means load applied from the indenter to the image for evaluation, and also includes influence by the weight of the indenter itself. Table 4 shows results.

In Table 4, the minimum weight not smaller than 40 gf is denoted as "A2", the minimum weight not smaller than 20 gf and smaller than 40 gf is denoted as "B2", and the minimum weight smaller than 20 gf is denoted as "C2". The greater minimum weight can be concluded as a fixed image being higher in resistance to scratch.

<Formation of Image>

An image was formed by using an image formation apparatus shown in FIG. 1. A construction of the image formation apparatus shown in FIG. 1 is shown below. A liquid developer 21 is brought up from a development tank 22 by an anilox roller 23. Excessive liquid developer 21 on anilox roller 23 is scraped off by an anilox restriction blade 24, and remaining liquid developer 21 is sent to a leveling roller 25. Liquid developer 21 is adjusted to be uniform and small in thickness, on leveling roller 25.

Liquid developer 21 on leveling roller 25 is sent to a development roller 26. Liquid developer 21 on development roller 26 is charged by a development charger 28 and developed on a photoconductor 29, and the excessive liquid developer is scraped off by a development cleaning blade 27. Specifically, a surface of photoconductor 29 is evenly charged by a charging portion 30, and an exposure portion 31 arranged around photoconductor 29 emits light based on prescribed image information to the surface of photoconductor 29. Thus, an electrostatic latent image based on the prescribed image information is formed on the surface of photoconductor 29. As the formed electrostatic latent image is developed, a toner image is formed on photoconductor 29. The excessive liquid developer on photoconductor 29 is scraped off by a cleaning blade 32.

The toner image formed on photoconductor 29 is primarily transferred to an intermediate transfer element 33 at a primary transfer portion 37, and the liquid developer transferred to intermediate transfer element 33 is secondarily transferred to a recording medium 40 at a secondary transfer portion 38. The liquid developer which remained on intermediate transfer element 33 without being secondarily transferred is scraped off by an intermediate transfer element cleaning portion 34.

In the present Example, the surface of photoconductor 29 was positively charged by charging portion 30, a potential of intermediate transfer element 33 was set to −400 V, and a potential of a secondary transfer roller 35 was set to −1200 V. A velocity of transportation of recording medium 40 was set to 400 mm/s. An amount of toner on development roller 26 was 1.5 g/m$^2$.

DISCUSSION

As shown in Table 4, adhesion strength (adhesion strength of toner particles to quality paper) was lower in Comparative Example 1 than in Examples 1 to 9 and resistance to scratch of an image was lower in Comparative Example 2 than in Examples 1 to 9. It can be concluded from this result that toner particles preferably contain at least 10 mass % and at most 40 mass % of an aliphatic polyester resin.

Adhesion strength was lower in Comparative Example 3 than in Examples 1 to 9. It can be concluded from this result that a resin preferably has an acid value not less than 20 mgKOH/g.

Adhesion strength was lower in Comparative Examples 4 and 5 than in Examples 1 to 9. It can be concluded from this result that a difference in acid value is preferably not more than 10 mgKOH/g.

Examples 1 to 3 and 5 to 9 were better in adhesion strength than Example 4. It can be concluded from this result that a resin further preferably has an acid value not less than 30 mgKOH/g.

Examples 1, 2, and 4 to 9 were better in resistance to scratch of an image than Example 3. It can be concluded from this result that toner particles further preferably contain at most 30 mass % of an aliphatic polyester resin.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A liquid developer, comprising:

an insulating liquid; and toner particles dispersed in said insulating liquid, said toner particles having a resin and a coloring agent, said resin containing at least 10 mass % and at most 40 mass % of an aliphatic polyester resin and at least 60 mass % and at most 90 mass % of an aromatic polyester resin, said resin having an acid value not less than 30 mgKOH/g and not more than 100 mgKOH/g, and a difference in acid value between said aliphatic polyester resin and said aromatic polyester resin being not less than 0 mgKOH/g and not more than 10 mgKOH/g.

2. The liquid developer according to claim 1, wherein both of said aliphatic polyester resin and said aromatic polyester resin have a first constitutional unit containing three or more carboxyl groups, as a constitutional unit derived from an acid component.

3. The liquid developer according to claim 2, wherein said first constitutional unit of said aliphatic polyester resin is identical to said first constitutional unit of said aromatic polyester resin.

4. The liquid developer according to claim 1, wherein said resin contains at least 10 mass % and at most 30 mass % of said aliphatic polyester resin and at least 70 mass % and at most 90 mass % of said aromatic polyester resin.

5. The liquid developer according to claim 1, wherein said aliphatic polyester resin or said aromatic polyester resin has a first constitutional unit containing three or more carboxyl groups, as a constitutional unit derived from an acid component.

* * * * *